US005150933A

United States Patent [19]

Myslicki et al.

[11] Patent Number: 5,150,933

[45] Date of Patent: Sep. 29, 1992

[54] LATCH HAVING TORSION SPRING LEG AND LEAF SPRING LEG

[75] Inventors: Robert J. Myslicki, W. Bloomfield; Hecham R. Khalid, Dearborn Heights; Michael E. Aubry, Shelby, all of Mich.

[73] Assignee: General Motors Corporation, Detroit, Mich.

[21] Appl. No.: 783,070

[22] Filed: Oct. 29, 1991

[51] Int. Cl.[5] ..... E05C 3/26

[52] U.S. Cl. ..... 292/216; 292/DIG. 14; 292/DIG. 72

[58] Field of Search ..... 292/216, DIG. 14, DIG. 43, 292/DIG. 72

[56] References Cited

U.S. PATENT DOCUMENTS

| | | | |
|---|---|---|---|
| 2,877,038 | 3/1959 | Kramer | 292/216 |
| 2,888,288 | 5/1959 | Rigaud | 292/46 |
| 3,047,325 | 7/1962 | De Vito | 292/216 |
| 3,347,584 | 10/1967 | Johnstone | 292/216 |
| 3,730,575 | 5/1973 | Arlauskas et al. | 292/216 |
| 3,743,335 | 7/1973 | Reilhac et al. | 292/DIG. 14 |
| 3,905,624 | 9/1975 | Fujita | 292/11 |
| 3,917,330 | 11/1975 | Quantz | 292/216 |
| 4,054,309 | 10/1977 | Borlinghaus | 292/216 |
| 4,667,990 | 5/1987 | Quantz | 292/201 |
| 4,917,420 | 4/1990 | Rogers, Jr. | 292/198 |
| 4,961,601 | 10/1990 | Lindholm et al. | 292/216 |
| 4,974,885 | 12/1990 | Yokoyama | 292/201 |
| 5,048,877 | 9/1991 | Rogers, Jr. et al. | 292/216 |

FOREIGN PATENT DOCUMENTS 125958 11/1984 European Pat. Off. ..... 292/216

*Primary Examiner*—Eric K. Nicholson

*Attorney, Agent, or Firm*—Raymond I. Bruttomesso, Jr.

[57] ABSTRACT

A latch assembly for latching and unlatching a pivotally movable closure panel of an automotive vehicle. A locking lever is pivotally supported by the vehicle for movement between a latched position in which an engaging portion thereof is latched to the striker on the closure panel to hold the latter in its closed position and an unlatched position in which the engaging portion releases the striker to allow the closure panel to be moved toward an open position. A detent lever is pivotally supported by the vehicle for movement between an engaged position in which a stepped portion thereof engages the locking lever to retain the latter in its latched position and a released position in which the first portion thereof releases the locking lever to allow the latter to be moved to its unlatched position. A spring carried by the vehicle has a first leg acting in torsion engaging the detent lever for biasing the detent lever towards the engaged position and a second leg acting as a leaf spring engaging the locking lever for biasing the locking lever towards the unlatched position. In operation, the locking lever is held in the latched position by the detent lever biased in the engaged position by the first leg of spring acting in torsion and when the detent lever is manually manipulable to the released position the second leg of the spring rotates the locking lever to the unlatched position releasing the striker.

4 Claims, 3 Drawing Sheets

LATCH HAVING TORSION SPRING LEG AND LEAF SPRING LEG

BACKGROUND OF THE INVENTION

1. Field of the Invention

This invention relates to a hood latch and, more particularly, to a hood latch having a helix spring which operates as a torsion spring in relation to the detent lever and as a torsion spring and leaf spring in relation to a fork bolt lever.

2. Description of the Relevant Art

It is known to have a hood latch assembly which includes a primary latch that is released by a handle located in the interior of a vehicle. The primary latch has a fork bolt lever which receives the striker and a detent lever to hold the fork bolt lever in a latched position. A spring biases the fork bolt lever to the unlatched position to ensure the fork bolt lever rotates to an unlatched position to release the striker when not retained by the detent lever. The detent lever has a separate spring to bias the detent lever to an engaged position holding the fork bolt lever in the latched position.

It is also known to have a primary latch which has a single spring to return both levers. The spring has a leg which acts in torsion to biases the detent lever to the engaged position. The interaction of components of the detent lever and the fork bolt lever and the relative position of the center of gravity and the pivot point of the fork bolt lever cause the fork bolt lever to rotate to the unlatched position when not retained by the detent lever in the engaged position. The desire to reduce the size and mass of the primary latch resulted in reduction of both in the fork bolt lever. This reduction in size and mass of the fork bolt lever moves the position of the center of gravity relative to the pivot point on the fork bolt lever causing the bolt to rotate to a latched position.

It would be desirable to provide a primary hood latch with a single spring which acts as a combined torsion and leaf spring for a fork bolt lever and a torsion spring for the detent lever.

SUMMARY OF THE INVENTION

This invention provides a latch assembly for latching and unlatching a pivotally movable closure panel to a motor vehicle body having a base plate fixed to the body of the motor vehicle and the base plate having an upwardly opening guide slot for receiving a striker of generally U-shaped configuration fixed to the closure panel. A fork bolt lever is pivotally mounted on the base plate by a first shaft. The fork bolt lever has a fork portion comprising a central U-shaped recess and two projecting portions provided on the two sides of the central recess which constitutes a first engaging portion engagable with the striker. The first projecting portion has an engaging edge. A detent lever is pivotally mounted on the base plate by a second shaft and rotates between an engaged position where a stepped portion of the detent lever engages the engaging edge of the fork bolt latch and a released position in which the stepped portion releases the fork bolt lever to allow the latter to move to its unlatched position. The detent lever has a manually manipulable release means operatively associated with the detent lever for moving the latter from the engaged position to the released position. A helix spring carried by the housing has a short leg acting in torsion engaging the detent lever to bias the detent lever towards the engaged position and an elongated leg acting as a combined torsion and leaf spring engaging the fork bolt lever to bias the fork bolt to the released position. A pop-up lever is pivotally mounted to the base plate for engaging the striker and moves between a raised extended position with the striker and closure panel raised and a lowered position with the striker engagable with the fork bolt lever. A compression spring carried by the housing engages the pop-up lever to bias the pop-up lever towards the raised extended position. In operation, the fork bolt lever is held in the latched position by the detent lever biased in the engaged position by the first leg of the spring acting in torsion. When the detent lever is manually manipulable to the released position, the second leg of the spring rotates the locking lever to the unlatched position releasing the striker. The pop-up lever, biased by the compression spring, urges the striker and closure panel towards the open position.

One object, feature and advantage of the invention resides in a spring carried by the housing having a pair of legs, one of the legs acting as a torsion spring and the other leg acting as a combined torsion and leaf spring where one of the legs engages a detent lever for biasing the detent lever towards the engaged position and the other leg engaging a locking lever for biasing the locking lever towards the unlatched position whereby the locking lever is held in the latched position by the detent lever biased in the engaged position by the spring and when the detent lever is manually manipulable to the released position the spring rotates the locking lever to the unlatched position releasing the striker.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
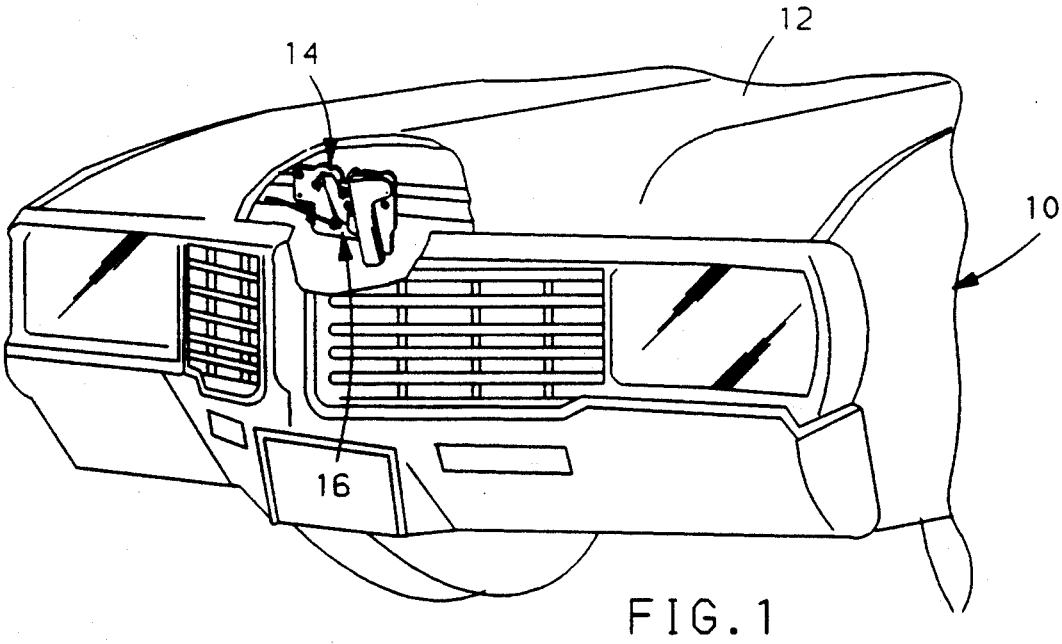
FIG. 1 is a partially broken away perspective view of the front portion of an automobile vehicle body having a closure latch according to this invention.

Referring to FIG. 1, there is shown an automobile vehicle body designated generally 10. An engine compartment, not shown, is accessible by a closure panel or hood 12 supported on the vehicle body 10 by conventional hinge means, not shown, for pivotal movement about a lateral, horizontal axis between a closed position of FIG. 1 and an open position. The hood 12 is releasably maintained in the closed position by a closure latching device according to this invention and designated generally 14, the latching device 14 being adapted for remote actuation from the interior of the vehicle body 10.

Figure 2:
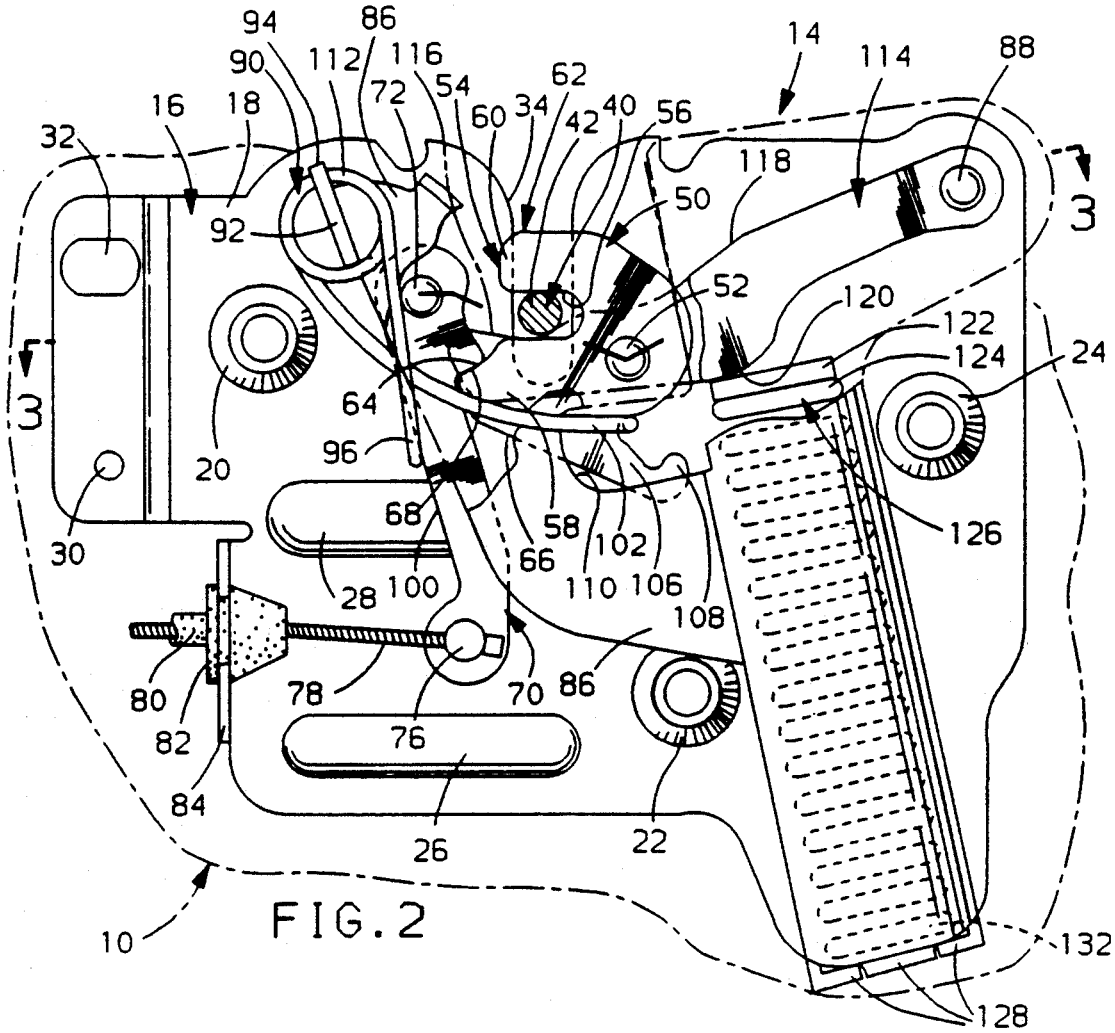
FIG. 2 is a front elevation view of the closure latch with the fork bolt lever in the latched position. The cover plate is broken away in a section for clarity of the underlying fork bolt lever and detent lever.
Figure 3:
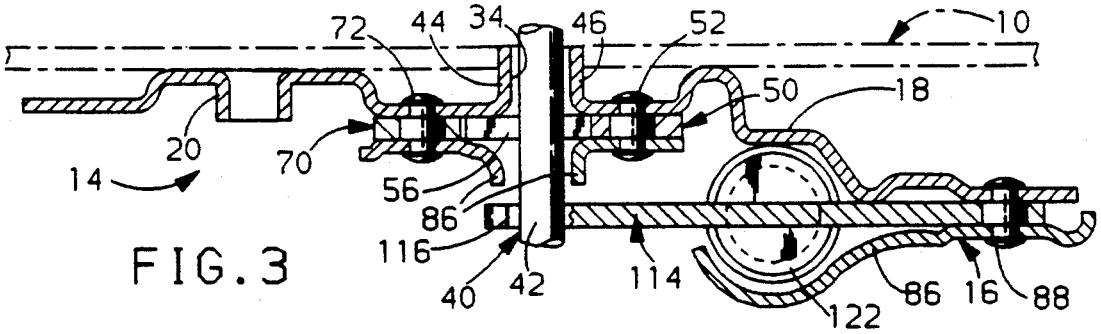
FIG. 3 is a sectional view taken in the direction of arrows 3—3 of FIG. 2.

Referring to FIG. 2, the closure latching device 14 has a housing 16 with a base plate 18 having a triplet of walled apertures 20, 22 and 24 for receiving a triplet of bolts, not shown, to secure the closure latching device 14 to the body of the motor vehicle 10. The base plate 18 is strengthened and stiffened by a pair of stiffening ribs 26 and 28 which protrude from the base plate 18. A hole 30 and slot 32, on the left side as viewed in FIG. 2, are provided in the base plate 18 for mounting a secondary closure latching device, not shown, which is not part of the invention and not needed in order to fully understand this invention. The base plate 18 also has an upwardly opening guide slot 34 for receiving a loop 42 of a striker 40, where the striker 40 is of generally U-shaped configuration and fixed to the closure panel 12 of the vehicle 10. Referring to FIG. 3, a pair of support flanges 44 and 46 protrude from the base plate 18 on the sides of the upwardly opening guide slot 34 for both assisting in the guiding of the striker 40 and added stiffness to the housing 16.

On the right side of the base plate 18, as viewed in FIG. 2 at approximately the central part thereof, there is provided a locking or fork bolt lever 50 pivotally mounted on the base plate 18 by means of a first shaft or rivet 52. The fork bolt lever 50 rotates between an unlatched position shown in FIG. 5 and an over-slam position shown in FIG. 6 through a latched position shown in FIG. 2. The fork bolt lever 50 has a fork portion 54 comprising a central U-shaped recess 56 with a pair of projecting portions 58 and 60 provided on the two sides of the central recess 56 which constitutes a first engaging portion 62 engagable with the loop 42 of the striker 40. The first projecting portion 58 has a pair of engaging edges 64 and 66, both separately engagable with a stepped portion 68 of a detent lever 70 as hereinafter described in more detail.

The detent lever 70 is pivotally mounted on the left hand side of the base plate 18 as viewed in FIG. 2, at approximately the central part thereof on a second shaft 72 which is fixed to the base plate 18. The detent lever 70 is rotatable about the second shaft 72 between an engaged position, shown in FIGS. 2 and 5, where the stepped portion 68 of the detent lever 70 engages one of the engaging edges 64 and 66 of the fork bolt lever 50, and a released position shown in FIG. 6. A retainer bushing 76 is received by the detent lever 70 to secure a release cable 78 to the detent lever 70. The cable 78 is connected to a primary hood release handle inside the car, not shown, and runs through a sheath 80 which is mounted at one end 82 to a mounting plate 84, where the mounting plate 84 projects perpendicular from the base plate 18, as seen in FIG. 4.

A cover plate 86 of the housing 16 sandwiches the fork bolt lever 50 and detent lever 70 to the base plate 18 adding rigidity to the closure latching device 14. The cover plate 86 is secured to the base plate 18 by the first shaft 52, the second shaft 72 and a third shaft 88 as seen in FIG. 3.

Figure 4:
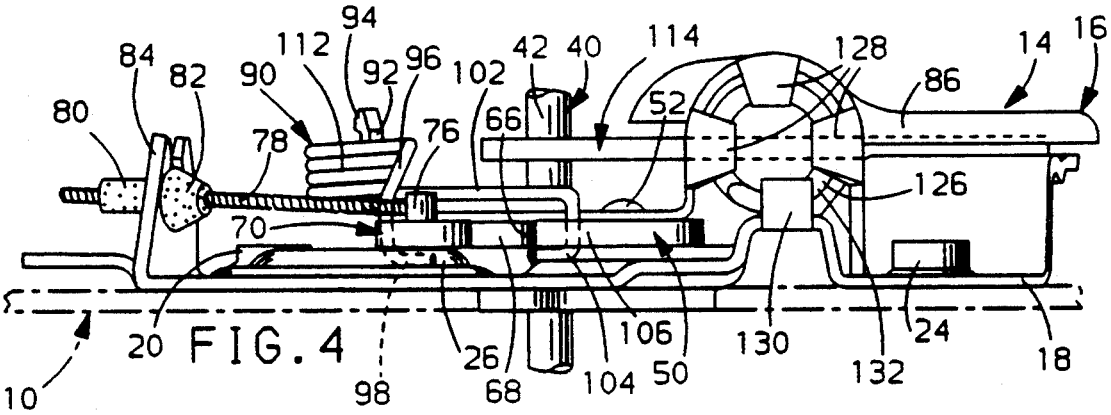
FIG. 4 is a bottom view of the closure latch taken generally perpendicular to the compression spring.

Referring to FIGS. 2 and 4, a helix spring 90 is carried by a protrusion 92 of the cover plate 86, where the protrusion 92 has a tab 94 to prevent the helix spring 90 from disengaging from the protrusion 92. The helix spring 90 has a short leg 96 extending over a portion of the detent lever 70, with a foot 98 of the short leg 96 wrapping around the detent lever 70 and engaging a trailing edge 100 of the detent lever 70.

Referring to FIGS. 2 and 4, an elongated leg 102 of the helix spring 90 extends over the cover plate 86, partially broken away for clarity, and the underlying portion of the detent lever 70 and the fork bolt lever 50. A foot 104 of the elongated leg 102 wraps around a leg 106 of the fork bolt lever 50, where the fork bolt 50 has a nub 108 protruding from the leg 106 for ensuring that the elongated leg 102 of the helix spring 90 does not slide off the leg 106 of the fork bolt lever 50 when the fork bolt lever 50 is in the unlatched position. The cover plate 86 has a cut-out 110, shown in phantom in FIG. 5, granting access to the fork bolt lever 50 for the foot 104 of the elongated leg 102.

The short leg 96 of the helix spring 90 acts in torsion to bias the detent lever 70 counterclockwise to the engaged position shown in FIG. 2, with a coil portion 112 of the spring 90 held in position by the tab 94. The elongated leg 102 of the helix spring 90 acts as a combined torsion and leaf spring to bias the fork bolt lever 50 to the released position shown in FIG. 5. The elongated leg 102 acts predominately as a leaf spring when the fork bolt lever 50 is between the over-slam position and the latched position to bias the fork bolt lever 50 toward the latched position. The elongated leg 102 biases towards an unbent position moving the fork bolt lever 50 toward the latched position. The coil portion 112 of the helix spring 90 expands slightly reducing the length of the elongated leg 102 as the fork bolt lever 50 moves toward the latched position. The elongated leg 102 of the helix spring 90 then acts predominately as a torsion spring when the fork lever 50 is between the latched position and the unlatched position biasing the fork bolt lever 50 toward the unlatched position. The foot 104 of the elongated leg 102 slides along the leg 106 of the fork bolt lever 50 toward the nub 108 as the elongated leg 102 rotates about the coil portion 112 to bias the fork bolt lever 50 to the unlatched position.

Figure 5:
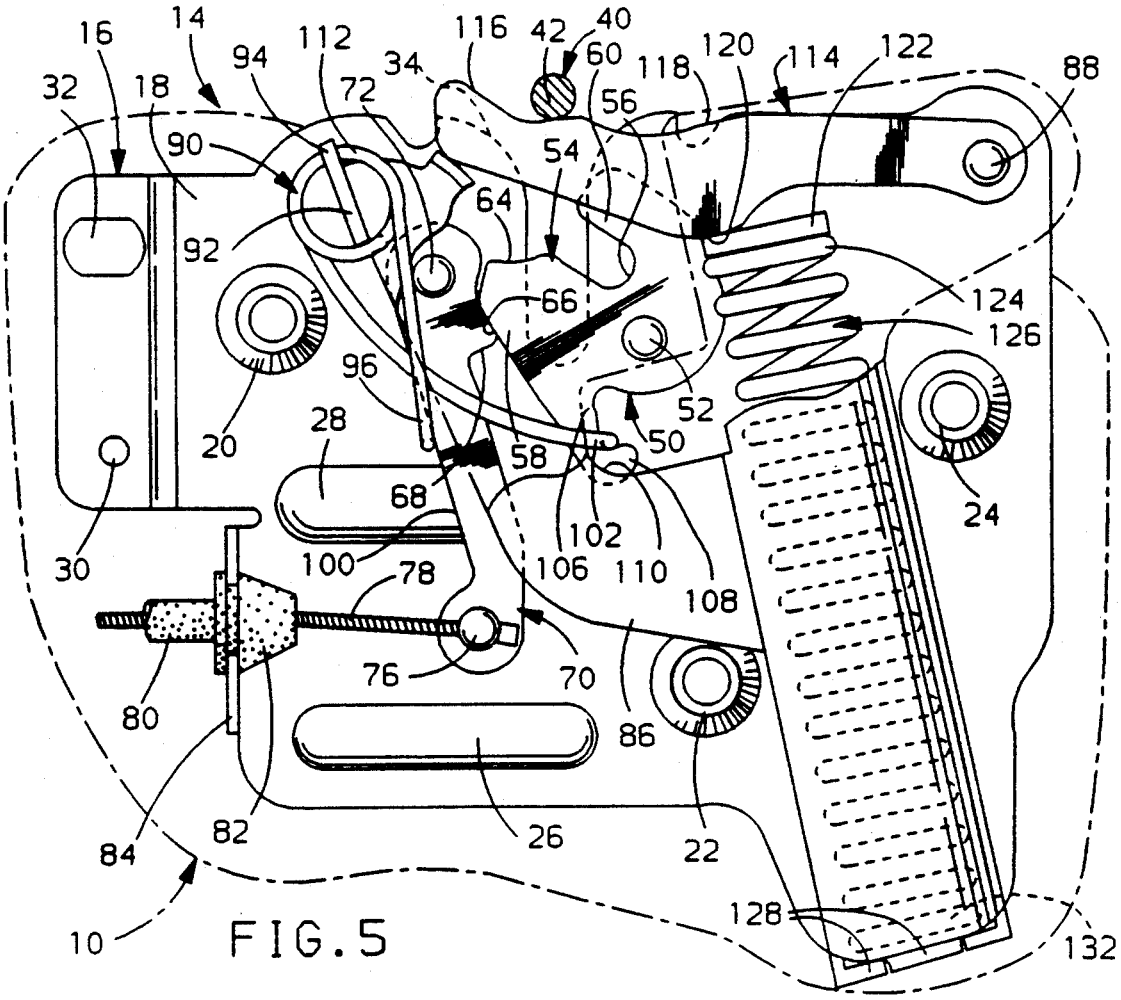
FIG. 5 is a front elevation view of the closure latch with the fork bolt lever in the unlatched position. The cover plate is broken away in a section for clarity of the underlying fork bolt lever and detent lever.

A pop-up lever 114 is pivoted on the housing 16 between the cover plate 86 and base plate 18 by the third shaft 88 as seen in FIG. 3. The pop-up lever 114 rotates between a compressed over-slam position shown in FIG. 6 and a raised extended position shown in FIG. 5 through a compressed latch position shown in FIG. 2. Referring to FIG. 5, the pop-up lever 114 has a striker receiving edge 116, a stop edge 118 and a spring engaging edge 120.

Referring to FIGS. 2 and 3, a spring cap 122 secured to a first end 124 of a compression spring 126 engages the spring engaging edge 120 of the pop-up lever 114 and biases the pop-up lever 114 towards the raised extended position shown in FIG. 5.

The compression spring 126 is enclosed in the housing 16 between the base plate 18 and the cover plate 86. The cover and the base plates 86 and 18 have a plurality of tabs 128 and 130 respectively which engage and retain a second end 132 of the compression spring 126, as seen in FIG. 4.

In operation, to open the hood 12, the remote actuator is manually moved which pulls the release cable 78. The release cable 78 pulls the retaining bushing 76 rotating the detent lever 70 about the second shaft 72 in a clockwise direction and moves the stepped portion 68, which has been mated with the first engaging edge 64 on the fork bolt lever 50, from the engaged position, shown in FIG. 2, to the released position shown in FIG. 6. The uncoupling of the stepped portion 68 of the detent lever 70 from the first engaging edge 64 on the fork bolt lever 50 permits the fork bolt 50 to rotate in a clockwise direction to the unlatched position, shown in FIG. 5, due to the bias provided by the elongated leg 102 of the helix spring 90 which acts as a torsion spring between the latched position and the unlatched position. The detent lever 70 is returned to the position shown in FIG. 5 by the short leg 96 of the helix spring 90 which acts in torsion as soon as the fork bolt lever 50 has rotated. The stepped portion 68 of the detent lever 70 engages the second engaging edge 66 when the fork bolt lever 50 is in the unlatched position.

Simultaneously with the fork bolt lever 50 rotating upward and releasing the striker 40 for upward movement, the pop-up lever 114 rotates upward to the raised extended position with the striker receiving edge 116 pushing the striker 40 and hood 12 upward. The first end 124 of the compression spring 126, which carries the spring cap 122, engages the spring engaging edge 120 of the pop-up lever 114 to bias the pop-up lever 114 towards the raised extended position. The movement of the pop-up lever 114 upward is limited by the stop edge 118 engaging the cover plate 86.

When the hood 12 is lowered, the striker 40 will travel downward until the loop 42 contacts the striker receiving edge 116 of the pop-up lever 114, where the pop-up lever 114 rotates downward. The striker 40, while still engaging the pop-lever 114, will engage the fork portion 54 of the fork bolt lever 50 and be received by the central U-shaped recess 56. The fork bolt lever 50 will be rotated towards the latched position. The detent lever 70 will initially rotate clockwise as the fork bolt lever rotates counterclockwise in order to let the first projecting portion 58 move downward past stepped portion 68 of the detent lever 70 and then counterclockwise allowing the stepped portion 68 of the detent lever 70 to engage the first engaging edge 64.

Figure 6:
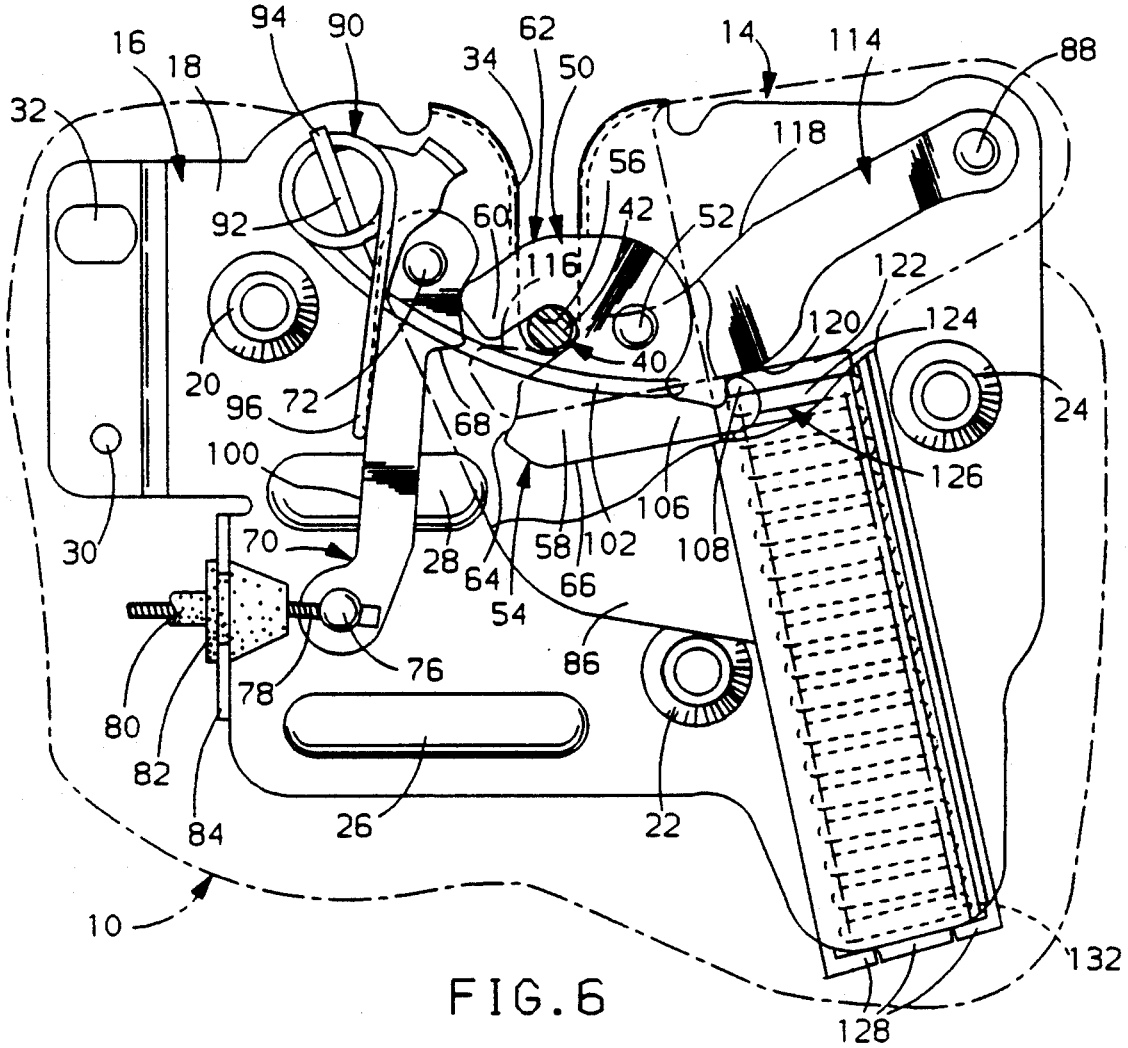
FIG. 6 is a front elevation view of the closure latch with the fork bolt lever shown in the over-slammed position and the detent lever in the released position.

The vehicle body 10 has several over-slam bumpers, not shown, to limit the downward movement of the hood 12. However, if the over-slam bumpers are not adjusted properly or the hood 12 flexes upon closing, the closure latching device 14 allows the striker 40 to move beyond the latched position. The fork bolt lever 50 rotates to the over-slam position, as seen in FIG. 6, with the upwardly opening guide slot 34 of the base plate 18 extending downward to allow for movement of the striker 40 to this position. The bias of both the compression spring 126 on the pop-up lever 114 and the elongated leg 102 of the helix spring 90 on the fork bolt lever 50 returns the closure latching device 14 to the latched position shown in FIG. 2.

Reiterating, the elongated leg 102 acts predominately as a leaf spring when the fork bolt lever 50 is between the over-slam position and the latched position to bias the fork bolt lever 50 toward the latched position. The elongated leg 102 of the helix spring 90 then acts predominately as a torsion spring when the fork bolt lever 50 is between the latched position and the unlatched position to bias the fork bolt lever 50 toward the unlatched position.

While an embodiment of the present invention has been explained, various modifications within the spirit and scope of the following claims will be readily apparent to those skilled in the art.

The embodiments of the invention in which an exclusive property or privilege is claimed are defined as follows:

1. A latch assembly for latching and unlatching a pivotally movable closure panel of an automotive vehicle comprising:

a housing which is adapted to be mounted to a vehicle body structure of the vehicle adjacent to a striker on the closure panel;

a locking lever pivotally supported on the housing by a first pivot means for movement between an over-slam position in which an engaging portion thereof is latched to the striker on the closure panel and an unlatched position in which the engaging portion releases the striker to allow the closure panel to be moved toward an open position and through a latched position located between the over-slam position and the unlatched position and in which the engaging portion thereof is latched to the striker on the closure panel to hold the latter in its closed position;

a detent lever pivotally supported on the housing by a second pivot means for movement between an engaged position in which a first portion thereof engages the locking lever to retain the latter in its latched position and a released position in which the first portion thereof releases the locking lever to allow the latter to be moved to its unlatched position and the detent having a manually manipulable release means operatively associated with the detent lever for moving the latter from the engaged position to the released position; and a spring having a coil portion carried by the housing distant from the first pivot means and the spring having a first leg, acting as a torsion spring, engaging the detent lever for biasing the detent lever towards the engaged position and having a second leg including an end and the end engaging the locking lever and the end being stationary relative to the locking lever when the locking lever is between the over-slam position and the latched position so that the second leg biases the locking lever towards the latched position and the end slideably engaging the locking lever when the locking lever is between the latched position and the unlatched position so that the second leg biases the locking lever towards the unlatched position whereby the locking lever is held in the latched position by the detent lever biased in the engaged position by the spring and when the detent lever is manually manipulable to the released position the spring rotates the locking lever to the unlatched position releasing the striker.

2. A latch assembly for latching and unlatching a pivotally movable closure panel of an automotive vehicle comprising:

a housing which is adapted to be mounted to a vehicle body structure of the vehicle adjacent to a striker on the closure panel;

a locking lever pivotally supported on the housing by a first pivot means for movement between an over-slam position in which an engaging portion thereof is latched to the striker on the closure panel and an unlatched position in which the engaging portion releases the striker to allow the closure panel to be moved toward an open position and through a latched position, located between the over-slam position and the unlatched position and in which the engaging portion thereof is latched to the striker on the closure panel to hold the latter in its closed position, and the locking lever having a leg;

a detent lever pivotally supported on the housing by a second pivot means for movement between an engaged position in which a stepped portion thereof engages the locking lever to retain the latter in its latched position and a released position in which the stepped portion thereof releases the locking lever to allow the latter to be moved to its unlatched position and the detent having a manually manipulable release means operatively associated with the detent lever for moving the latter from the engaged position to the released position; and a spring having a coil portion carried by the housing distant from the first pivot means and the second pivot means and the spring having a first leg acting as a torsion spring engaging the detent lever for biasing the detent lever towards the engaged position and a second leg terminating in a foot and acting as a leaf spring with the foot engaging the leg of the locking lever and the foot being stationary relative to the leg of the locking lever when the locking lever is between the over-slam position and the latched position so that the second leg biases the locking lever towards the latched position and the second leg acting as a torsion spring with the foot slideably engaging the leg of the locking lever when the locking lever is between the latched position and the unlatched position so that the second leg biases the locking lever towards the unlatched position whereby the foot of the second leg being stationary relative to the leg of the locking lever between the over-slam position and the latched position of the locking lever and the locking lever is held in the latched position by the detent lever biased in the engaged position by the first leg of the spring acting in torsion and when the detent lever is manually manipulable to the released position the second leg of the spring slideably engaging the locking lever rotates the locking lever to the unlatched position releasing the striker.

3. A latch assembly for latching and unlatching a pivotally movable closure panel to a motor vehicle body comprising:

a housing having a base plate fixed to the body of the motor vehicle and the base plate having an upwardly opening guide slot for receiving a striker of generally U-shaped configuration fixed to the closure panel and the housing having a cover plate;

a fork bolt lever pivotally mounted on the base plate by means of a first pivot means and the fork bolt lever has a fork portion comprising a central U-shaped recess and two projecting portions provided on the two sides of the central recess which constitutes a first engaging portion engageable with the striker when the fork bolt lever is in an over-slam position and engagable with the striker when the fork bolt lever is in a latched position to hold the closure panel and releasable from the striker when the fork bolt lever is in an unlatched position to allow the closure panel to be moved toward an open position and the first projecting portion having an engaging edge and the fork bolt lever having a leg;

a detent lever pivotally mounted on the base plate by means of a second pivot means and rotatable about the second pivot means between an engaged position where a stepped portion of the detent lever engages the engaging edge of the fork bolt latch and a released position in which the stepped portion releases the fork bolt lever to allow the latter to move to its unlatched position and the detent lever having a manually manipulable release means operatively associated with the detent lever for moving the latter from the engaged position to the released position;

a helix spring having a coil portion carried by the housing distant from the first pivot means and the second pivot means and the helix spring having a short leg acting as a torsion spring for engaging the detent lever to bias the detent lever towards the engaged position and an elongated leg terminating in a foot and acting as a combined torsion and leaf spring for engaging the fork bolt lever and acting as a leaf spring with the foot engaging the leg of the fork bolt lever and the foot being stationary relative to the leg of the fork bolt lever when the fork bolt lever is between the over-slam position so that the second leg biases the fork bolt lever towards the latched position and then as a torsion spring with the foot slideably engaging the leg of the fork bolt lever when the fork bolt lever is between the latched position and the unlatched position so that the second leg biases the fork bolt towards the released position;

a pop-up lever pivotally mounted to the base plate for engaging the striker and movement between a raised extend position with the striker and closure panel in the open position and a lowered position with the striker engagable with the fork bolt lever; and a linear compression spring carried by the housing between the base plate and the cover plate and the compression spring engaging the pop-up lever to bias the pop-lever towards the raised extended position whereby the locking lever is held in the latched position by the detent lever biased in the engaged position by the short leg of the spring acting in torsion and when the detent lever is manually manipulable to the released position the elongated leg of the spring rotates the locking lever to the unlatched position releasing the striker and simultaneously the pop-up lever biased by the compression spring urges the striker and closure panel towards the open position.

4. A latch assembly as in claim 3 wherein the housing has a cover plate which carries the helix spring.

* * * * *